US011390970B2

(12) United States Patent
Yamamoto

(10) Patent No.: US 11,390,970 B2
(45) Date of Patent: Jul. 19, 2022

(54) PAPER YARN, PAPER CLOTH AND FABRIC PRODUCTS

(71) Applicant: Rinnovation Co., Ltd., Tokyo (JP)

(72) Inventor: Naoto Yamamoto, Tokyo (JP)

(73) Assignee: Rinnovation Co., Ltd.

( * ) Notice: Subject to any disclaimer, the term of this patent is extended or adjusted under 35 U.S.C. 154(b) by 0 days.

(21) Appl. No.: 16/609,702

(22) PCT Filed: Apr. 10, 2019

(86) PCT No.: PCT/JP2019/015609
§ 371 (c)(1),
(2) Date: Oct. 30, 2019

(87) PCT Pub. No.: WO2020/208740
PCT Pub. Date: Oct. 15, 2020

(65) Prior Publication Data

US 2021/0047759 A1 Feb. 18, 2021

(51) Int. Cl.

| | |
|---|---|
| ***D03D 15/65*** | (2021.01) |
| ***D02G 3/08*** | (2006.01) |
| ***D21F 11/16*** | (2006.01) |
| ***D21H 11/12*** | (2006.01) |
| ***D03D 15/217*** | (2021.01) |

(52) U.S. Cl.
CPC ..... *D03D 15/65* (2021.01); *D02G 3/08* (2013.01); *D03D 15/217* (2021.01); *D21F 11/16* (2013.01); *D21H 11/12* (2013.01)

(58) Field of Classification Search
None
See application file for complete search history.

(56) References Cited

U.S. PATENT DOCUMENTS 6,902,649 B1 * 6/2005 Satyavolu ..... A21D 2/188 162/91
8,043,839 B2 * 10/2011 Weiner ..... D06L 4/40 800/312

(Continued)

FOREIGN PATENT DOCUMENTS

EP 0931862 A1 * 7/1999 ..... D04H 1/4266
JP 2000-032852 A 2/2000

(Continued)

OTHER PUBLICATIONS

Notice of Reasons for Refusal for JP Application No. 2019-520671, dated Jun. 5, 2019 (19 pages).

*Primary Examiner* — Khoa D Huynh
*Assistant Examiner* — Grace Huang
(74) *Attorney, Agent, or Firm* — Harness, Dickey & Pierce, P.L.C.

(57) ABSTRACT

Articles are prepared from paper containing different types of fibers. In a granulation step, bagasse is pulverized to produce a sugar cane pulp powder of granules. In a pulping process, pulp is produced from Manila hemp. In a mixing step, sugar cane pulp powder, and the pulp produced in preceding steps, are mixed. In the papermaking process, Japanese washi paper is produced by using a mixture of pulp powder and pulp. In a slitting process, the produced Japanese washi paper is slit. In a twisting process, the slit Japanese washi paper yarn is twisted to produce a paper yarn.

6 Claims, 5 Drawing Sheets

(56) References Cited

U.S. PATENT DOCUMENTS

| | | | | |
|---|---|---|---|---|
| 8,119,385 | B2 * | 2/2012 | Mathur | C12N 9/00 435/212 |
| 8,795,469 | B2 * | 8/2014 | Golfman | D21C 3/02 162/148 |
| 9,339,582 | B2 * | 5/2016 | Tokita | A61L 15/425 |
| 9,574,075 | B2 * | 2/2017 | Kosonen | C08L 23/12 |
| 9,587,349 | B2 * | 3/2017 | Medoff | D21H 25/04 |
| 9,932,707 | B2 * | 4/2018 | Dottori | D21H 11/12 |
| 10,323,354 | B2 * | 6/2019 | Kawahara | B01D 71/10 |
| 10,546,696 | B2 * | 1/2020 | Fukuoka | H01M 10/52 |
| 10,557,105 | B1 * | 2/2020 | Tran | C11B 3/00 |
| 10,704,197 | B2 * | 7/2020 | Martin | D21C 9/10 |
| 11,155,002 | B2 * | 10/2021 | Pans | B27N 3/08 |
| 2004/0060673 | A1 * | 4/2004 | Phillips | D21C 3/20 162/22 |
| 2006/0180285 | A1 * | 8/2006 | Yang | D21H 11/12 162/90 |
| 2008/0146701 | A1 * | 6/2008 | Sain | C08L 29/04 524/9 |
| 2008/0227753 | A1 * | 9/2008 | Lian | A23L 33/22 514/57 |
| 2009/0047497 | A1 | 2/2009 | Park | |
| 2010/0163018 | A1 * | 7/2010 | Gifford | C08H 8/00 127/43 |
| 2011/0036525 | A1 * | 2/2011 | Kim | D21H 11/12 162/148 |
| 2011/0151516 | A1 * | 6/2011 | Van Der Heide | C08B 37/0003 435/72 |
| 2014/0174680 | A1 * | 6/2014 | Hawkins | D21C 5/00 162/72 |
| 2017/0114189 | A1 * | 4/2017 | Theyson | C08L 1/02 |
| 2019/0136448 | A1 * | 5/2019 | Tachibana | D21C 9/10 |
| 2019/0203413 | A1 * | 7/2019 | Tan | D21C 9/007 |
| 2020/0190737 | A1 * | 6/2020 | Barla | B01F 7/041 |
| 2020/0224365 | A1 * | 7/2020 | Kinumoto | D21C 3/02 |
| 2020/0377732 | A1 * | 12/2020 | Pal | C08J 3/09 |
| 2021/0054567 | A1 * | 2/2021 | Flynn | D21H 11/12 |
| 2021/0054568 | A1 * | 2/2021 | Siani | D21H 11/12 |

FOREIGN PATENT DOCUMENTS

| | | | | | |
|---|---|---|---|---|---|
| JP | 2002-339285 | A | | 11/2002 | |
| JP | 2002339285 | A | * | 6/2005 | |
| JP | 2005-299034 | A | | 10/2005 | |
| JP | 2006-274531 | A | | 10/2006 | |
| JP | 2007-009402 | A | | 1/2007 | |
| JP | 2009-091701 | A | | 4/2009 | |
| JP | 2009-530505 | A | | 8/2009 | |
| KR | 20130090429 | A | * | 8/2013 | |
| PL | 221539 | B1 | * | 4/2016 | |
| WO | WO-2004061224 | A1 | * | 7/2004 | D21C 5/00 |

* cited by examiner

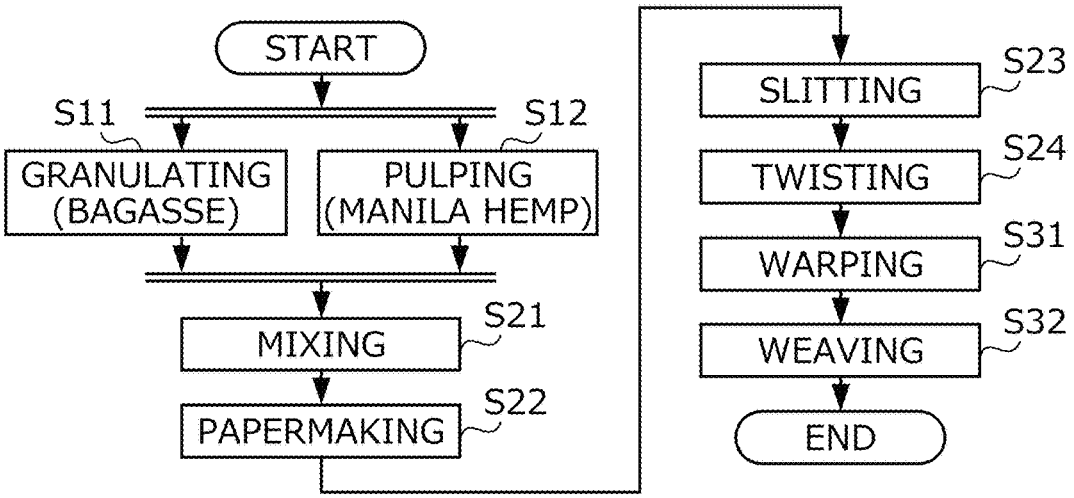
FIG. 3
FIG. 4A
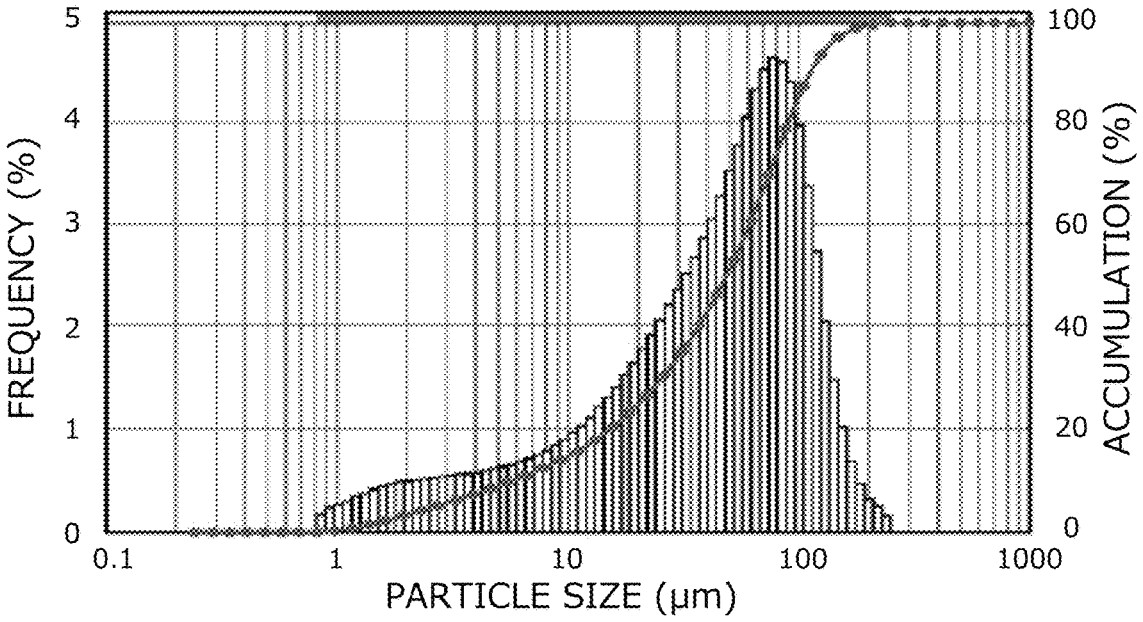
FIG. 4B
| PARAMETERS | VALUES |
|---|---|
| MV (μm) | 54.83 |
| MN (μm) | 1.461 |
| MA (μm) | 13.62 |
| CS | 0.44065 |
| MEDIAN DIAMETER (μm) | 42.86 |

| MASS RATIO (%) | Tensile strength (N) | | Knot strength (N) | Hook strength (N) |
|---|---|---|---|---|
| | DRY | WET | | |
| 0 | 4.82 | 4.62 | 4.72 | 7.73 |
| 20 | 4.32 | 3.97 | 3.91 | 6.65 |
| 25 | 3.97 | 2.91 | 0.04 | 5.45 |
| 30 | 3.45 | 2.89 | 3.54 | 5.94 |
| 50 | 2.33 | 1.10 | 2.13 | 4.13 |
FIG. 5
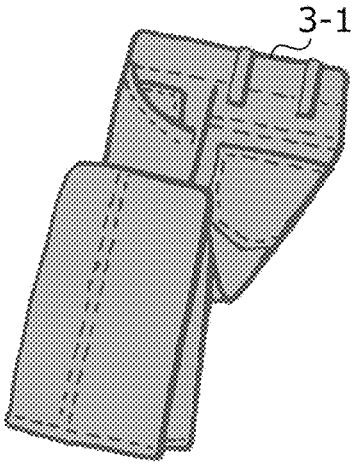
FIG. 6A
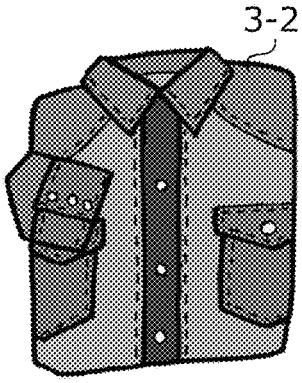
FIG. 6B
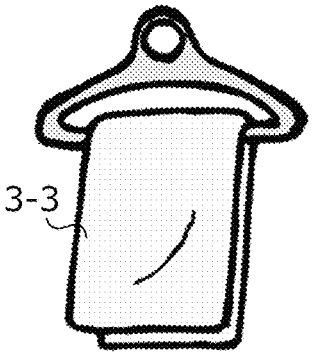
FIG. 6C
| MASS RATIO OF BAGASSE (%) | REDUCTION RATE OF ODOR COMPONENTS (%) | | |
|---|---|---|---|
| | AMMONIA | ACETIC ACID | ISOVALERIC ACID |
| 0 | 14 | 63 | 48 |
| 15 | 17 | 74 | 49 |
| 20 | 17 | 74 | 55 |
| 30 | 22 | 74 | 58 |
| 40 | 21 | 79 | 57 |
| 50 | 26 | 79 | 65 |
FIG. 7

| WEFT AND WARP YARN OF CLOTHING FABRIC (DENIM) | | REDUCTION RATE OF ODOR COMPONENTS (%) | | |
|---|---|---|---|---|
| | | Ammonia | Acetic Acid | Isovaleric Acid |
| A | PAPER YARN OF 30% BAGASSE AND COTTON YARN DYED WITH INDIGO | 96 | 99 | 99 |
| B | PAPER YARN OF 30% BAGASSE AND COTTON YARN WITHOUT DYEING | 96 | 98 | 99 |
| C | INDIGO DYEING OF CLOTHING FABRIC B | 93 | 99 | 99 |
| D | COTTON YARN AND COTTON YARN DYED WITH INDIGO | 90 | 98 | 99 |

FIG. 8

| MASS RATIO OF BAGASSE (%) | | Y: NUMBER OF FIBERS IN MANILA HEMP | X: AMOUNT OF SUGAR CANE PULP POWDER | RATIO X/Y | ESTIMATED MASS RATIO OF BAGASSE (%) |
|---|---|---|---|---|---|
| 1a | 20 | 156 | 96 | 0.62 | 20.0 |
| 1b | 25 | 141 | 108 | 0.77 | 24.9 |
| 1c | 30 | 162 | 132 | 0.81 | 26.4 |
| 1d | 50 | 114 | 132 | 1.16 | 37.7 |

FIG. 9

PAPER YARN, PAPER CLOTH AND FABRIC PRODUCTS

CROSS REFERENCE TO RELATED APPLICATIONS

This application is a U.S. National Stage Application of International Application No. PCT/JP2019/015609, filed on Apr. 10, 2019, which is related to Japanese Application No. 2019-520671, filed on Apr. 10, 2019. The entire disclosures of the above applications are incorporated herein by reference.

TECHNICAL FIELD

The present invention relates to products made using paper.

RELATED ART

Japanese Patent Application Laid-Open No. 2009-530505 discloses a technique for removing lignin from grass fibers to produce paper and fibers.

Paper yarns formed by twisting paper are known in the art. When manufacturing paper from yarn, if foreign matter is mixed with the main yarn material, for example, Manila hemp, the resulting paper has a significantly reduced strength, and thus the paper cannot be readily processed to make useful paper products (paper yarn, paper cloth, and the like). On the other hand, there also exist fibers that are either burned as fuel or discarded as waste. An example of such a fiber is sugar cane pulp, referred to as bagasse, and for which effective methods of utilization are sought.

It is an object of the present invention to produce useful paper products that contain different types of fibers.

SUMMARY

To realize this objective, the present invention provides a paper yarn formed from a paper that comprises a first fiber having a lignin content equal to or greater than a first threshold and a second fiber having a lignin content less than the first threshold.

A process of removing lignin from the first fiber need not be carried out.

The first fibers may be processed into granules.

The first fibers may be bagasse.

The mass ratio of the first fiber may be 3% or more and 40% or less.

The present invention also provides a paper cloth that is woven using the above-mentioned paper yarn.

The present invention also provides a fabric product that is produced using the above-mentioned paper cloth.

In addition, a specific covered region may be irradiated with light for a predetermined length of time or longer, as appropriate.

Advantageous Effect of the Invention

In accordance with the present invention, papers containing different types of fibers can be used to produce useful products.

BRIEF DESCRIPTION OF THE DRAWINGS

FIG. 3 exemplary shows a manufacturing process of paper yarn and paper cloth FIGS. 4A and 4B show exemplary particle size distributions of sugar cane pulp powder.

FIG. 5 is a diagram showing an example of test results of physical properties of paper yarns.

FIGS. 6A-6C show examples of a fabric product that can be produced using a paper cloth FIG. 7 shows an example of test results showing a deodorizing effect of Japanese washi paper FIG. 8 shows an example of test results showing a deodorizing effect of fabric products.

FIG. 9 is a diagram showing an example of an estimation result of a mass ratio in a paper yarn.

DETAILED DESCRIPTION

1. Embodiment

The present invention relates to a fabric product such as a paper yarn, a paper cloth (a cloth woven using a paper yarn), and a cloth produced using a paper cloth (hereafter referred to as a "paper fabric product"). Examples of the paper yarn, the paper cloth, and the paper fabric product of the present invention are described below.

Figure 1:
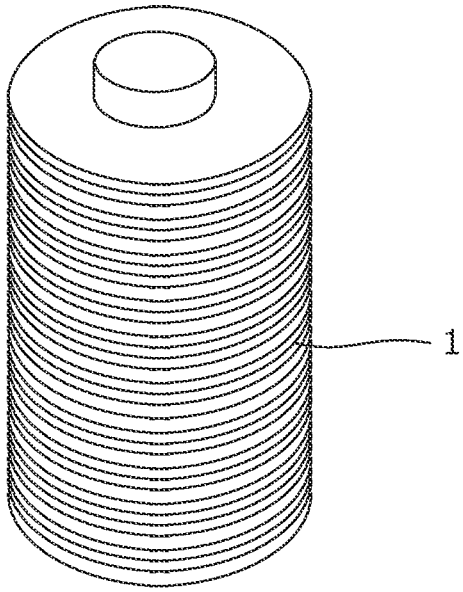
FIG. 1 shows an appearance of a paper yarn according to an embodiment

FIG. 1 shows an appearance of a paper yarn 1 according to an embodiment. The paper yarn 1 is a paper yarn produced using bagasse and Manila hemp as raw materials. Bagasse is a fibrous pulp that is produced by squeezing sugar cane. The paper yarn is a yarn made by slicing and twisting paper (generally Japanese washi paper). Details of the paper yarn 1 will be described later, including a method of manufacture thereof.

Figure 2:
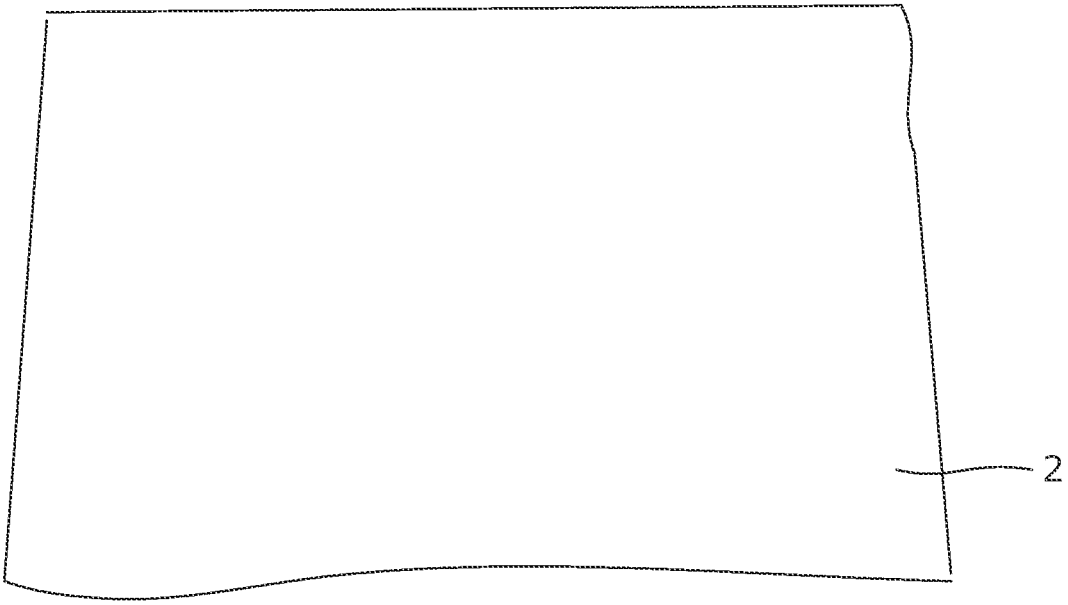
FIG. 2 shows an appearance of a cloth according to another embodiment.

FIG. 2 shows an appearance of a paper cloth 2 according to another embodiment. The paper cloth 2 is a cloth obtained by knitting a paper yarn 1 into a weft yarn and an indigo-dyed cotton yarn into a warp yarn in a twill weave, and may also be referred to as a cotton paper cloth. In FIG. 2, a paper cloth 2 is shown that is folded and generally faces rearward. The front side of the paper cloth 2 is dyed; the warp yarn is a cotton yarn, which is dyed.

FIG. 3 shows an example of a process of manufacture of the paper yarn 1 and the paper cloth 2. In each step shown in FIG. 3, an operator operates various manufacturing machines to process materials and the like. As described above, the raw materials of the paper yarn 1 are bagasse and Manila hemp.

First, a granulation step of pulverizing bagasse to produce a sugar cane pulp powder of granules is performed in step S11. In the granulation step, for example, a machine referred to as a jet mill is used. The jet mill is a device equipped with a nozzle from which high-pressure air or steam is ejected as an ultra-high-speed jet for blowing onto particles to pulverize the particles into fine particles by causing the particles to impact each other. An example of a measurement result of a particle size of the sugar cane pulp powder produced in the granulation step by the particle size distribution measuring apparatus will now be described with reference to FIG. 4.

FIG. 4 shows an example of a particle size distribution of a sugar cane pulp powder. In FIG. 4A, a bar graph is also shown in which the horizontal axis represents a particle diameter (in um (micrometers)) and the vertical axis represents a frequency (%). Frequency denotes a ratio of a number of particles of a particle size to a total number of particles. In FIG. 4B, as characteristic values calculated from the particle size distribution, MV (volume average) is 54.83 μm, MN (average diameter) is 1.461 μm, MA (area average diameter) is 13.62 μm, CS (specific surface area, surface area per unit volume) is 0.44065, and median diameter is 42.86 μm. It is of note that the particle size distribution of the sugar cane pulp powder produced in the granulation step is not limited to the above, and may differ therefrom to some extent.

In step S12, a pulping process for producing pulp from Manila hemp is performed. In the pulping process, for example, there is performed a process that involves chipping Manila hemp, adding a chemical and boiling the chipped Manila hemp at high temperature and high pressure to remove foreign matter, followed by washing with use of an enzyme to remove lignin, and then carrying out bleaching with the chemical. As a result of the lignin removing process, a lignin content of the pulp is very low, usually less than 2%.

On the other hand, in the granulation step, no lignin removing process is performed. It is known that Bagasse contains 40-60% cellulose, 20-30% pentozan, 15-20% lignin, and 1-3% ash (refer to, Toyoshi Kashiwagi, "Technology for the Production of Functional Dietary Fibers from Bagasse", Agriculture and Horticultural Vol. 82 No. 4 pp. 509-514, April 2007). As a result of analysis by the applicant of the components of the sugar cane pulp powder, a result was obtained in which 88.0 g of dietary fiber and 2.8 g of ash were present per 100 g. From these results, it is understood that the lignin content (mass ratio) of the sugar cane pulp powder is about 15 to 20%, and is at least 2% or more, compared to bagasse.

After the granulation step and the pulping step, a mixing step of mixing the sugar cane pulp powder and the pulp is performed in step S21. In this embodiment, in the mixing step, the sugar cane pulp powder having a mass ratio of 30% and the pulp having a mass ratio of 70% are mixed. Hereafter, the "mass ratio" of bagasse (sugar cane pulp powder) and Manila hemp (pulp) refers to the mass ratio when mixed in the mixing step unless otherwise specified.

Next, in step S22, a papermaking process is performed to make Japanese washi paper using a mixture of sugar cane pulp powder and pulp. In the papermaking process, for example, Japanese washi paper is produced by introducing a mixture into a papermaking machine. The paper machine has a wire section, a pressing section and a drying section. In the wire section, the paper machine levels a water-diluted mixture to produce wet paper. In the pressing section, the paper machine compresses the wet paper. In the drying section, the paper machine heats and dries the wet paper. Production of paper by the paper machine is finished by winding the Japanese washi paper thus produced into a roll.

After the papermaking process is complete, a slitting process for slitting the produced Japanese washi paper is performed (in step S23). In the slitting process, for example, a machine referred to as a slitter is used in which rolled paper is wound while being cut into narrow strips. Specifically, the slitter slits the produced Japanese washi paper to have a width of about 1 mm to 4 mm. Next, a process of twisting the slit Japanese washi paper yarn to produce the paper yarn 1 is performed in step S24. In the twisting process, for example, a twisting machine that twists several Japanese washi paper yarns to produce paper yarn is used.

Next, as a step of producing the paper cloth 2 using the paper yarn 1 produced in the above step, a warp step and a weave step are performed. In the present embodiment, since cotton yarn is used as the warp yarn as described above, in the warp step, an operation of winding the cotton yarn around a plurality of beams is performed by using a machine referred to as a warping machine, which turns a beam to wind the warp yarn around the beam, for example, in step S31. Then, in the weave step, an operation of producing the paper cloth 2 is performed by using a weaving machine for weaving the cloth by crossing the warp yarn and the weft yarn in step S32.

The paper yarn 1 and the paper cloth 2 produced by the above manufacturing process have the following characteristics. The paper yarn 1 is formed of paper containing a first fiber (bagasse in this example) having a lignin content of 2% or more and a second fiber (pulp processed with Manila hemp in this example) having a lignin content of less than 2%. Here, 2% is the value of the mass ratio, which is an example of the "threshold" of the present invention.

The first fiber (bagasse) is not subjected to a lignin removing process. Therefore, time and cost incurred can be reduced as compared with a case in which, for example, both the first fiber and the second fiber are subject to the lignin removing process.

Bagasse is known to be a very hard fiber, and when the fibers are mixed as they are, the fibers tend to stand upright upon twisting a paper yarn. In the present embodiment, bagasse as the first fiber is processed into granules by the granulation step described above. This prevents staggering from occurring in the paper yarn as compared with a case in which granule processing is not performed.

The mass ratio of bagasse, which is the first fiber to be mixed with the second fiber, i.e., pulped Manila hemp, when the paper yarn 1 is produced is 30% as described above. A test result comparing physical properties of paper yarns in which the first fiber and the second fiber have different mass ratios will now be described.

FIG. 5 shows an example of the test results of the physical properties of the paper yarn. In the example shown in FIG. 5, values representing the physical properties of each paper yarn in which the mass ratio of bagasse is varied "0%", "20%", "25%", "30%" and "50%," are measured.

Specifically, a tensile strength (dry and wet, in Newtons), a knot strength (Z-method, in Newtons), and a hook strength (in Newtons) are measured, which strengths are commonly used as indicators of yarn strength. The values indicate that the larger the numerical value, the harder the cut paper yarn is and the more durable the cut paper yarn is. In the example shown in FIG. 5, each of the physical property values tends to gradually decrease as the mass ratio of the bagasse increases (the nodule strength of the mass ratio of 25% is considered to be an abnormal value), and in particular, the mass ratio rapidly decreases when in excess of between 30% to 50%.

In the above test result, the paper yarn is produced by the test machine, but it is expected that a strength of the paper yarn will also increase when the paper yarn is produced by the product machine since accuracy of the machine is increased. From the above, the applicant has determined that when the bagasse granulated in the particle size distribution shown in FIG. 4 is used, if the mass ratio of the bagasse is 40% or less, a paper yarn having a strength usable as a material of the paper cloth is formed.

As described above, the upper limit of the mass ratio of the bagasse is 40% in the present embodiment, but for example, if the particle size distribution of the granulated bagasse (sugar cane pulp powder) greatly differs from the distribution shown in FIG. 4, it is expected that the strength of the paper yarn will also change, and therefore, an upper limit capable of securing the strength of the paper yarn may be used in accordance with the particle size distribution of the bagasse (sugar cane pulp powder) to be used.

In addition, the applicant ascertained that the mass ratio of the bagasse needs to be 3% or more in order to be mixed with the second fiber; the lower limit of the mass ratio is 3%. This is because if the mass ratio is further lowered, the sugar cane pulp powder will not spread over the entire mixture, which causes shading of the sugar cane pulp powder at the Japanese washi paper-making stage, and results in an uneven strength of the paper dependent on a position of the paper yarn.

Since the mass ratio of the bagasse of the paper yarn 1 of this example is 30%, an occurrence of unevenness of strength is suppressed as compared with a case in which the mass ratio is less than the lower limit (3%), and deterioration in the strength of the paper yarn as a whole is suppressed as compared with a case in which the mass ratio exceeds the upper limit (40%). In addition, in the present embodiment, by using bagasse as the first fiber, it is possible to effectively utilize bagasse that is often otherwise discarded as waste. In the production of paper, if foreign matter is mixed present in addition to the main material, a strength of a resulting paper may be significantly decreased.

In the present embodiment, when pulped Manila hemp, which is the second fiber, is used as the main material, even if bagasse, which is the first fiber, is mixed with the main material, a decrease in strength of the paper yarn is suppressed, as shown in FIG. 5. The reason for this is considered to be because the lignin content of the bagasse was 2% or more, and thus the content of lignin exhibited an effect of adhering the fibers of Manila hemp. In other words, in the present embodiment, the first fiber having a high lignin content is included, so that a useful article (the paper yarn 1 and the paper cloth 2) can be manufactured by using paper containing different types of fibers.

By processing the paper cloth 2, various fabric products such as clothes, bags, towels, cushions, bedding and stationery can be manufactured.

FIG. 6 shows an example of a fabric product that can be produced using the paper cloth 2. In FIG. 6A, the fabric product 3-1 (denim), in FIG. 6B, the fabric product 3-2 (shirt), and in FIG. 6C, the fabric product 3-3 (towel) are shown (referred to as "fabric product 3" unless the products are specifically distinguished from each other). Fabric product 3 is an example of a useful product made with paper containing different types of fibers. Each of the fabric products 3 is manufactured by a conventional manufacturing method such as cutting and sewing, except that the paper cloth 2 is used.

The paper cloth 2 is a cloth knitted by twill weaving. However, a paper cloth woven by another method such as plain weaving or satin weaving may be used depending on the fabric product. The paper cloth 2 has a cotton yarn as the warp yarn and a paper yarn as the weft yarn, but other yarns such as silk yarn and hemp yarn may be used as the warp yarn, or both may be paper yarns. The paper cloth may be woven by any method using any yarn as long as the paper yarn is used for at least one of the warp yarn and the weft yarn.

Since the paper yarn 1 is lighter in mass than cotton yarn, it is possible to produce a fabric product that is lighter in mass than a like product that is produced, for example, from cotton fabrics using a cotton yarn for both warp and weft yarns. In addition, since the paper yarn 1 is harder than the cotton yarn, it is possible to manufacture a garment that has a lesser tendency to bend and a lesser tendency to stick to skin than a like product manufactured from a cotton cloth. Further, by mixing bagasse as the material of the paper yarn 1, it is possible to manufacture clothing that has a lesser tendency to bend and a lesser tendency to stick to skin, even compared to a like product manufactured using, for example, a paper yarn in which only Manila hemp is used.

Further, it has been confirmed that a deodorizing effect is enhanced by mixing bagasse as a material of the paper yarn 1.

FIG. 7 shows an example of a test result showing the deodorizing effect of Japanese washi paper. In the example of FIG. 7, the measurement results of the reduction rate of the odor components (ammonia, acetic acid, and isovaleric acid) using six types of Japanese washi paper produced by mixing bagasse with Manila hemp or Manila hemp alone are shown.

The reduction rate is a value calculated by (concentration of the blank minus the concentration of the sample measurement)/(concentration of the blank)×100. The blank denotes a cardinality of odor components in spatial where there is no sum of papers. Sample measurements are the cardinality of odor components in a space that has been filled with sum papers for a certain period of time (in parts per million). For example, in the case of Japanese washi paper made of 100% Manila hemp (0% by mass of bagasse), ammonia is reduced by 14%, acetic acid by 63%, and isovaleric acid is reduced by 48%.

In the six types of Japanese washi paper, the mass ratio of bagasse increased as follows: 0%, 15%, 20%, 30%, 40%, and 50%. The reduction rate of ammonia correspondingly increased as follows: 14%, 17%, 17%, 22%, 21%, and 26, and thus an increase in tendency in proportion to the mass ratio of bagasse was shown. Similarly, the acetic acid reduction rate also increased as follows: 63%, 74%, 74%, 74%, 79%, 79%; while isovaleric acid increased as follows: 48%, 49%, 55%, 58%, 57%, and 65%.

FIG. 8 shows an example of a test result showing the deodorizing effect of a fabric product. In the example shown in FIG. 8, the measurement results of the reduction rate of the odor component by four types of denim clothing fabrics A to D are shown. Clothing fabric A is a clothing fabric in which the paper yarn 1 of 30% bagasse is a weft yarn and the cotton yarn dyed with indigo is a warp yarn. Clothing fabric B is a clothing fabric in which the warp yarn of the clothing fabric A is produced (yarn not bleached and dyed) is replaced by a cotton yarn. Clothing fabric C is obtained by indigo dyeing the clothing fabric B. Clothing fabric D is obtained by replacing the weft yarn of the clothing fabric A with cotton yarn (ordinary denim clothing fabric).

In each case, a reduction rate as high as 90% or more was measured compared to the Japanese washi paper shown in FIG. 7, but the clothing fabrics A to C using the paper yarn 1 exhibited a higher reduction rate for all odor components compared to a normal clothing fabric using only cotton yarn. As will be understood from the above test results, the clothing fabric in which the paper yarn 1 is used provides an enhanced deodorizing effect as compared with a clothing fabric in which the paper yarn 1 is not used.

As described above, the paper yarn 1 contains a large amount of lignin. For example, the clothing fabrics A to C produced by using the paper yarn 1 are characterized in that the lignin content is higher than that of the clothing fabric D; and the higher the lignin content, the more easily the paper is discolored. On the other hand, some fabric products, such as denim, are made attractive by color fade as a result of use. Since such a fabric product can be manufactured using the paper yarn 1, color fade can occur faster than when the fabric product is manufactured using only cotton yarn, for example.

In the paper yarn 1, as described above, a 30% mass ratio of granulated bagasse (sugar cane pulp powder) and a 70% mass ratio of pulped Manila hemp were mixed as raw materials, but from the yield, there was a possibility that a fine powder having a particularly small particle diameter was removed from the sugar cane pulp powder in the wire making process. Therefore, microscopic observation of the paper yarn was carried out, and the actual mass ratio of the sugar cane pulp powder in the paper yarn was estimated.

FIG. 9 shows an example of the estimation result of the mass ratio in the paper yarn. In FIG. 9, the results of counting the number of fibers in Manila hemp included in the unit area of each paper yarn and the amount of sugar cane pulp powder in each of the four types of paper yarn 1*a*, the 1*b*, the 10*c*, and the 1*d* in which the mass ratio of bagasse (sugar cane pulp powder) at the time point of the material was set to 20%, 25%, 30%, and 50% are shown. The ratio of the amount of sugar cane pulp powder to the number of fibers of Manila hemp in the paper yarns 1*a*, 1*b*, 1*c*, and 1*d* was "0.62", "0.77", "0.81", and "1.16," respectively.

Since the yield of the paper yarn 1*a* in which the mass ratio of bagasse was 20% was close to 100%, it was assumed that all of the sugar cane pulp powder was fixed in the paper yarn 1*a*. Based on this assumption, the mass ratio of bagasse (sugar cane pulp powder) in the paper yarns 1*b*, 1*c*, and 1*d* was calculated to be "24.9%", "26.4%", and "37.7%," respectively. The correlation between the mass ratio in the mixing step and the mass ratio in the produced paper yarn is shown in FIG. 10.

Figure 10:
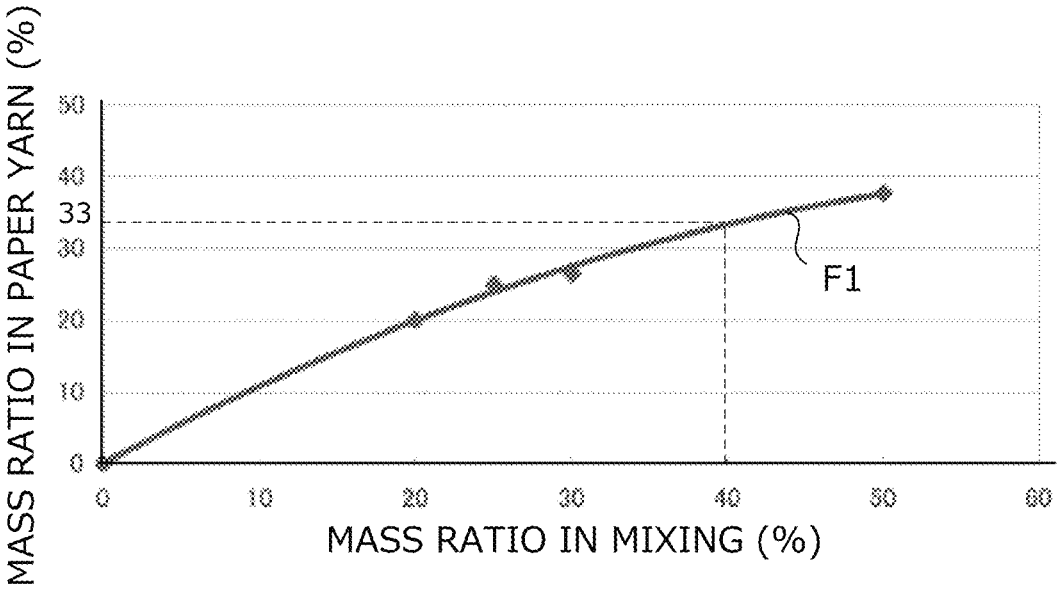
FIG. 10 shows an example of a correlation of mass ratios

FIG. 10 shows an example of the correlation of the mass ratio. In the example shown in FIG. 10, there is depicted a curve F1, an approximate expression of which is $y=-0.0081x^2+1.1565\times+0.0891$, calculated based on the mass ratio shown in FIG. 9. As described above, the applicant has determined that a paper yarn having a strength usable as a material for a paper cloth is formed when the mass ratio of bagasse in the mixing process is 40% or less. According to the approximate curve F1, if the mass ratio of the bagasse in the mixing step is 40%, the mass ratio of the bagasse in the paper yarn is about 33.4%.

That is, in the paper-yarn state, if the mass ratio of the bagasse is 33.4% or less, it is considered that a paper yarn having sufficient strength as the material for the paper cloth is formed. Since the yield is sufficiently high in the vicinity of 3% which is the lower limit of the mass ratio of the bagasse, the lower limit of the mass ratio of the bagasse may be 3% even in the paper-yarn state. Based on these numerical values, even if the mass ratio of the bagasse in the mixing process of the paper yarn and the paper cloth is not known, it is possible to judge whether the paper yarn and the paper cloth produced have been formed from the paper yarn and the paper cloth has a strength usable as the material for the paper cloth.

2. Modification

The embodiment described above is only an example of the embodiment of the present invention, and may be modified as follows. The embodiment and each modification may be implemented in combination as necessary.

2.1 Use in Decorations

As described above, the fabric product of the present invention is characterized in that it is easily discolored. Lignin is discolored by reaction with oxygen. However, when exposed to light, the discoloration reaction is accelerated. This property may be exploited to produce textile products with patterns or graphics by discoloring only certain areas of the textile product. The discoloration process for discoloring only certain areas of the fabric article will now be described with reference to FIG. 11.

Figure 11A:
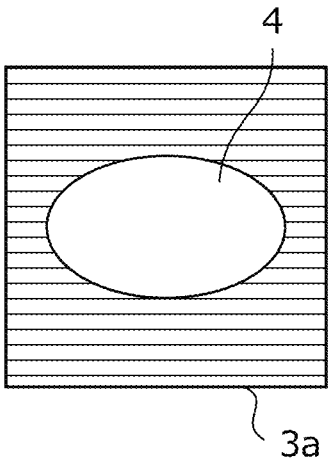
FIGS. 11A-11C are diagrams showing an example of a color change process according to a modification.
Figure 11B:
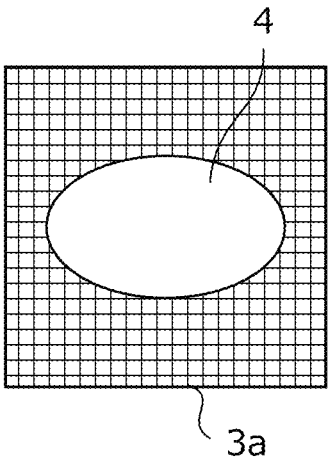

FIG. 11 shows an example of the discoloration process of this modification. In the example of FIG. 11, an example of the discoloring of the fabric 3*a*, for example, denim, will be described. In the discoloration process, first, the pattern paper 4 is attached to the fabric product 3*a*, as shown in FIG. 11A. Next, the fabric product 3*a* to which the pattern paper 4 is attached is irradiated with light by lamps or the like to discolor the fabric product 3*a*, as shown in FIG. 11B. The stronger the light that is used for irradiation and the longer the irradiation time, the greater the degree of discoloration. Therefore, the irradiation time of the light is determined according to an intensity of light to be used and a degree of discoloration to be achieved.

Figure 11C:
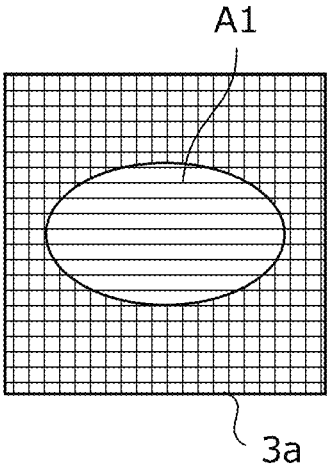

When the pattern paper 4 is removed after attaining a color to an extent required, as shown in FIG. 11C, a fabric product 3a is completed by drawing a pattern in the form of the area A1l covered by the pattern paper. As described above, the fabric product 3*a* is a fabric product in which a specific area (area A1 in the case of FIG. 11) is covered and a region around the specific area is irradiated with light for a predetermined period of time or longer, as appropriate. The fabric product 3a is a fabric product in which a pattern or a pattern represented by the area A1 is drawn.

In the example of FIG. 11, a simple pattern is shown, but a more complicated pattern may be formed by covering a region having a more complicated shape. In addition, by changing a light irradiation time for each region, a graded drawing can be formed with varying degrees of discoloration. For example, in the case of the example of FIG. 11, by irradiating the area A1 with light while covering the area A1 with another pattern paper having a shape and a size different from those of the area A1, the periphery of the area A1 is further discolored. Since a part of the region A1 that is not covered by the new pattern paper changes color and a region that is covered by the new pattern paper does not change color, a drawing with three gradations is formed.

In the present modification, as described above, a pattern or a drawing can be formed on a fabric product without use of ink, a print sheet, or the like. In addition, for example, a pattern drawn with ink or by use of a print sheet may become thinner and disappear due to washing or abrasion. In contrast, if the fabric product is used and color change progresses, the design or the like depicted in the present modification example does not disappear and the design can be enjoyed for a long time since the color change of the design and that of the periphery progresses at the same time evenly.

2-2. Lignin Content

As described in the embodiment, the paper yarns of the present invention are formed from paper comprising a first fiber (e.g., bagasse) having a lignin content greater than or equal to a threshold and a second fiber (e.g., pulped Manila hemp) having a lignin content less than or equal to the threshold. In the examples, the lignin content of each fiber is expressed as a mass ratio, but the present invention is not limited thereto.

For example, the lignin content may be expressed as a volume ratio. In this case, for example, the volume ratio of lignin of the plant fiber (Manila hemp or the like) on which the lignin removing operation has been performed is always lower than the lignin volume ratio, and thus as small a value as possible may be used as the threshold value. Plant fibers are natural fibers taken from plants, many of which contain large amounts of cellulose, hemicellulose, and lignin. In this case, it is sufficient that a plant fiber subjected to the lignin removing process is used as the second fiber, and a plant fiber having a higher lignin content than the second fiber is used as the first fiber.

2-3. 1st Fiber

Since plant fiber contains a large amount of lignin as described above, the lignin content will be less than the threshold unless the lignin removing process is performed. In other words, as the first fiber, all plant fibers that are not subjected to the lignin removing process can be used, provided that sufficient strength is obtained when the first fiber is made into a paper yarn. In addition, some plant fibers have a lower rigidity than bagasse and therefore, if the plant fibers are sufficiently soft so as not to require spinning when they are formed into a paper yarn, they may be mixed with the second fibers without being granulated as bagasse.

2-4. 2nd Fiber

The second fiber is not limited to Manila hemp, and may be a fiber that is often used as a raw material of Japanese washi paper, such as, for example, wax, salmon, and goose peel. The second fiber may be a fiber of hardwood, softwood, or the like, which is a raw material of paper. In conclusion, the second fiber may be a plant fiber having a lignin content that is made lower than the threshold value (or a plant fiber having a lignin content that is originally lower than the threshold value) by the lignin removing process as described above.

The invention claimed is:

1. A paper yarn formed from paper, the paper comprising:

a mixture of a first fiber and a second fiber, the first fiber being bagasse, the second fiber being a fiber other than bagasse, wherein the first fiber has a lignin content greater than or equal to 15%; and the second fiber is a plant fiber having a lignin content less than 2%, wherein the second fiber is made from Manila hemp.

2. A paper cloth woven using the paper yarn according to claim 1.

3. A fabric product produced using the paper cloth of claim 2.

4. A paper yarn formed from paper, the paper comprising:

a mixture of a first fiber and a second fiber, wherein the first fiber is bagasse having a lignin content greater than or equal to a predetermined threshold and a mass ratio more than or equal to 3% and less than or equal to 40%; and the second fiber is a fiber other than bagasse and has a lignin content less than the threshold, wherein the second fiber is made from Manila hemp.

5. A paper cloth woven using the paper yarn according to claim 4.

6. A fabric product produced using the paper cloth of claim 5.

* * * * *